US006532859B1

(12) United States Patent
Kuhn et al.

(10) Patent No.: US 6,532,859 B1
(45) Date of Patent: Mar. 18, 2003

(54) COMPRESSOR, IN PARTICULAR FOR A VEHICLE AIR CONDITIONING SYSTEM

(75) Inventors: Peter Kuhn, Weinheim (DE); Frank Obrist, Dornbirn (AT); Jan Hinrichs, Friedrichsdorf (DE); Hans-Jürgen Lauth, Neu Anspach (DE)

(73) Assignee: Luk Fahrzeug-Hydraulik GmbH & Co. KG (DE)

( * ) Notice: Subject to any disclaimer, the term of this patent is extended or adjusted under 35 U.S.C. 154(b) by 0 days.

(21) Appl. No.: 09/832,058

(22) Filed: Apr. 10, 2001

Related U.S. Application Data

(62) Division of application No. 09/033,787, filed on Mar. 3, 1998, now Pat. No. 6,250,204.

(30) Foreign Application Priority Data

| | | |
|---|---|---|
| Mar. 3, 1997 | (DE) | 197 08 522 |
| Mar. 3, 1997 | (DE) | 197 08 517 |
| Mar. 3, 1997 | (DE) | 197 08 598 |
| Feb. 25, 1998 | (DE) | 198 07 947 |

(51) Int. Cl.[7] ..... F01B 3/00
(52) U.S. Cl. ..... 92/71; 417/269
(58) Field of Search ..... 92/12.2, 57, 71; 417/269

(56) References Cited

U.S. PATENT DOCUMENTS

| | | | | |
|---|---|---|---|---|
| 3,712,759 A | | 1/1973 | Olson | |
| 3,861,829 A | | 1/1975 | Roberts et al. | |
| 4,175,915 A | * | 11/1979 | Black et al. | 417/222 |
| 4,178,136 A | | 12/1979 | Reid et al. | |
| 4,480,964 A | | 11/1984 | Skinner | |
| 4,508,495 A | | 4/1985 | Monden et al. | |
| 4,586,874 A | | 5/1986 | Hiraga et al. | |
| 4,696,629 A | | 9/1987 | Shiibayashi et al. | |
| 4,801,248 A | * | 1/1989 | Tojo et al. | 417/222 |

(List continued on next page.)

FOREIGN PATENT DOCUMENTS

| | | |
|---|---|---|
| DE | 47019 | 11/1963 |
| DE | 1216338 | 5/1966 |
| DE | 3103147 | 8/1982 |
| DE | 3810127 | 10/1989 |
| JP | 2265877 | 5/1992 |

OTHER PUBLICATIONS

Patent Abstracts of Japan, vol. 007, No. 141 (M–223), Jun. 21, 1983 & JP 58 053687 A (Hitachi Seisakusho KK), Mar. 30, 1983, abstract.

*Primary Examiner*—Hoang Nguyen
(74) *Attorney, Agent, or Firm*—Ostrolenk, Faber, Gerb & Soffen, LLP

(57) ABSTRACT

A compressor, in particular for a vehicle air conditioning system, with a housing, which contains a device for conveying a compressed medium driven by a drive shaft, designed as an axial piston machine and having at least one piston reciprocating in a cylinder block and a take-up plate connected to the piston working in combination with a swash plate rotating around a rotational axis, whereby the swash plate is connected to the drive shaft by a carrier and whereby the take-up plate encompasses a support device working in combination with a non-rotating thrust bearing. The compressor is distinguished by the fact that the housing has two housing sections, each with a clamping shoulder, between which the cylinder block is clamped, and that the drive shaft is carried in the cylinder block by a fixed bearing and/or that the carrier and the drive shaft are materially connected together or are made as one piece and/or that the support device includes a projection projecting from the take-up plate, preferably connected to this as one piece, and a support element, that the support element has a first sliding surface, which works in combination with a bearing surface (second bearing surface) of the thrust bearing, and that the projection and the support element are positively connected together via a second sliding surface.

9 Claims, 4 Drawing Sheets

U.S. PATENT DOCUMENTS

| | | | | | |
|---|---|---|---|---|---|
| 4,815,358 | A | | 3/1989 | Smith | |
| 5,013,222 | A | | 5/1991 | Sokol et al. | |
| 5,137,431 | A | | 8/1992 | Kiyashi et al. | 417/269 |
| 5,231,914 | A | * | 8/1993 | Hayase et al. | 92/12.2 |
| 5,370,505 | A | | 12/1994 | Takenaka et al. | 417/269 |
| 5,509,346 | A | | 4/1996 | Kumpf | |
| 5,528,976 | A | | 6/1996 | Ikeda et al. | |
| 5,540,560 | A | | 7/1996 | Kimura et al. | |
| 5,573,379 | A | | 11/1996 | Kimura et al. | 417/269 X |
| 5,613,836 | A | | 3/1997 | Takenaka et al. | |
| 5,674,054 | A | | 10/1997 | Ota et al. | 417/269 |
| 5,768,974 | A | | 6/1998 | Ikeda et al. | |
| 5,941,157 | A | * | 8/1999 | Tokumasu | 417/269 X |
| 5,941,693 | A | * | 8/1999 | Kato | 417/269 |
| 6,250,204 | B1 | * | 6/2001 | Kuhn et al. | 92/12.2 |

* cited by examiner

COMPRESSOR, IN PARTICULAR FOR A VEHICLE AIR CONDITIONING SYSTEM

DESCRIPTION

This is a division of application Ser. No. 09/033,787, filed Mar. 3, 1998 now U.S. Pat. No. 6,250,204.

BACKGROUND OF THE INVENTION

The invention relates to a compressor, in particular for a vehicle air conditioning system according to the heading of claim 1.

Conventional compressors for air conditioning systems, so-called air conditioning compressors, having a housing that surrounds a device for the transfer of the compressed medium. The pump unit, in the form of an axial piston pump, has at least one piston that can reciprocate within a cylinder block, and a swash plate rotating around a rotational axis, working in combination with a non-rotating take-up plate located within the compressor housing, which is connected to the pistons. The swash plate is coupled to the drive shaft via a carrier. The take-up plate rests upon a support device on a non-rotating thrust bearing. The thrust bearing serves to intercept the torque that is transferred from the rotating swash plate to the take-up plate. Normally a compressor of the type described here has several pistons. These transfer the medium to be compressed from a suction area to a compression area. The forces required for the compression of the coolant are very high. They are transferred into the housing via the drive shaft, which gives rise to high air home/structure borne noise emissions. Familiar compressors of this type also have the disadvantage that the carriers surround the drive shaft or the transfer of torque from the swash plate takes place using pegs or by pressing. This leads to a relatively high space requirement. Furthermore, it has also become evident that compressors of the conventional type are of expensive construction and encompass many components in the area where the take-up plate is supported. Furthermore, the take-up plate is often weakened by the support device.

SUMMARY OF THE INVENTION

The object of the invention is to create a compressor of the type discussed here of simple and compact construction that gives rise to low air-borne/structure-borne noise emissions and in particular can be economically manufactured.

For the achievement of this objective a compressor is suggested that has the characteristics described in claim 1. It is characterised by the fact that the forces required for the compression of the coolant are principally carried in the inside of the compressor housing. To achieve this the housing is made up of two sections, which each have a clamping shoulder. The cylinder block, in which at least one of the pistons of the device for conveying the compression medium reciprocates, is clamped between these. The drive shaft of the device for conveying the compression medium is fixed in the cylinder block by a fixed bearing.

It is therefore possible to transfer the forces required for the reciprocal movement of the pistons and the compression of the coolant via the swash plate, which is rigidly connected to the drive shaft, into the drive shaft and therefore into the inside of the housing. From the drive shaft the forces travel into the cylinder block, which is clamped by the two housing sections. The lines of force only run via the small housing section that runs outside via the fixing point of the cylinder block. The radiation area for air-borne/structure-borne noise is therefore reduced to a minimum. Furthermore, the housing is stabilised by the fixing points of the two housing sections to such a degree that when the device for conveying compressed medium is in operation only low vibrations occur at this point, greatly reducing the emission of noise.

Alternatively, or in addition to the above mentioned measures, it is suggested that the carrier and the drive shaft are fastened together by adhesion—preferably by welding, soldering and/or gluing—or manufactured as a single piece. This type of design makes it unnecessary for the drive shaft to be surrounded by the carrier, so less space is required. It is also evident that due to this construction the swash plate can swing out further, meaning that the compressor can be shorter. According to the invention, the construction of the compressor can also be simplified in that the take-up plate support device encompasses one of these projections, constructed as part of the take-up plate, that works in combination with a single support element. The number of parts is thus reduced to a minimum. The support element has a first sliding surface that works in combination with a first bearing surface of the support bearing, upon which the take-up plate is supported, for example in the compressor housing. The projection and the support element are positively connected together via a second sliding surface, whereby, on the one hand, a secure retention of the support element onto the projection is ensured without the need for additional support elements and, on the other hand, the relative movement of the two sections on the sliding surface is possible without giving rise to high loading.

A compressor design is preferred that is characterised by the fact that the cylinder block has a rotating mounting flange. The height of this flange is much less that that of the cylinder block. The mounting area of the housing can therefore be greatly reduced, so that the sound emission area is extremely small.

Particularly preferred is a compressor design that is characterised by the fact that the two housing sections are welded together. The vibrations and pulsations emitted by the operating compressor are conducted directly by the welded area of the housing sections, which are therefore connected together in a particularly stable and low vibration manner. This leads to a reduction in noise emissions. Furthermore, assembly parts, such as flanges and screws fitted outside the compressor housing, can be avoided completely, thus avoiding the surfaces of parts, which could contribute to noise emissions. The pump is therefore very light and compact, which greatly reduces the total noise emission area.

Further advantageous developments are described in the other subclaims.

The inventions is described in more detail below based on a drawing. This shows:

BRIEF DESCRIPTION OF THE DRAWINGS

The invention is described in more detail below based on the following drawings.

DETAILED DESCRIPTION OF THE PREFERRED EMBODIMENT

Figure 1:
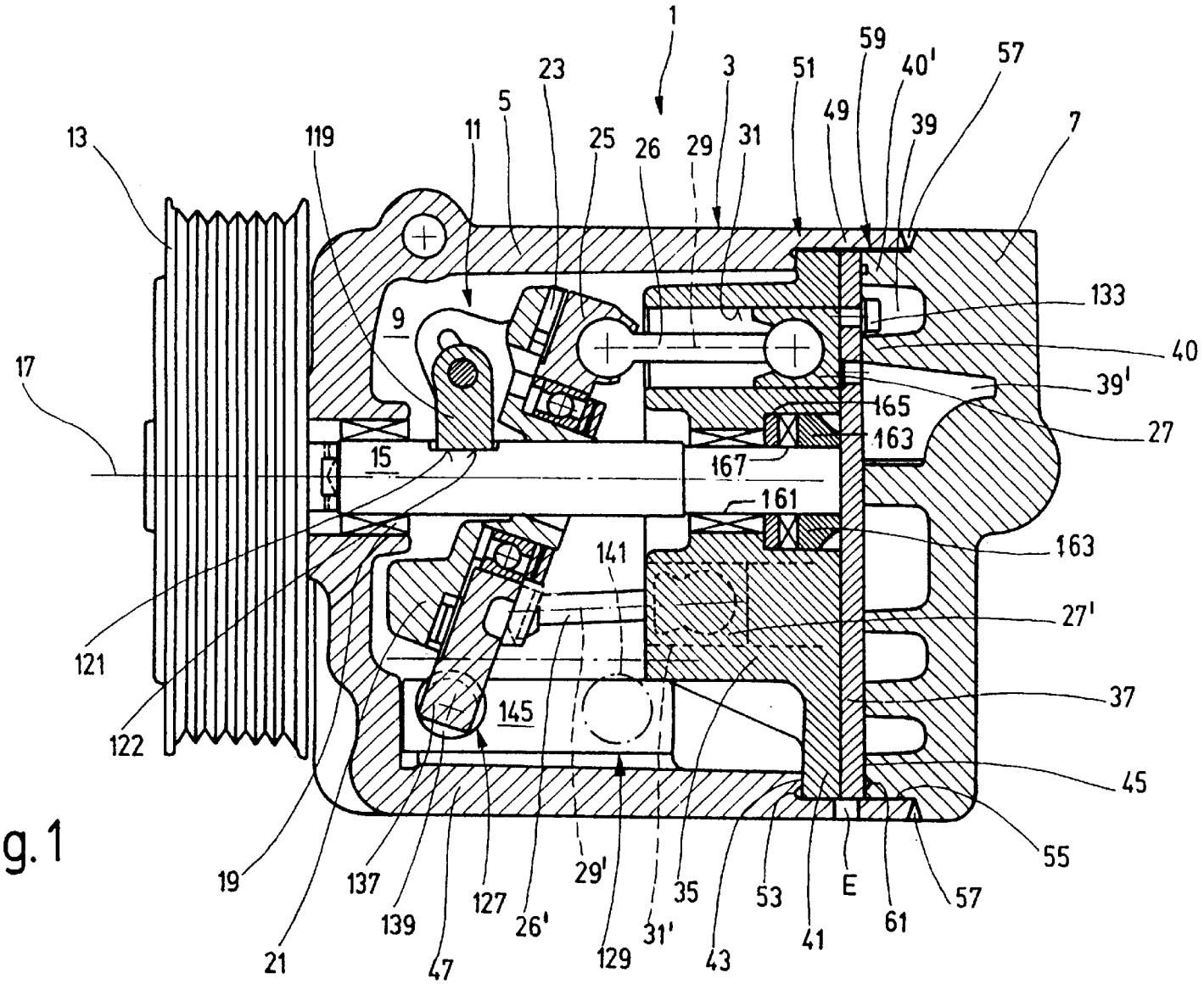
FIG. 1 is an example of a longitudinal section of a compressor design.

The longitudinal section shown in FIG. 1 shows a compressor 1 with a housing 3 that encompasses a first housing section 5 and a second housing section 7. The first housing section 5 includes a hollow 9 also denoted as a driving area, in which a compressed medium transfer device 11 is located. This is driven in an appropriate manner, for example via a pulley 13, which may, for example, be driven by a vehicle internal combustion engine and via a drive shaft 15 rotating around rotational axis 17. The drive shaft is carried in the housing 3 close to the pulley 13 by a movable bearing 19. A swash plate 21 is rigidly connected to the drive shaft 15, i.e. it turns with the drive shaft and is secured against axial displacement, i.e. against displacement in the direction of the axis of rotation 17. The swash plate 21 acts via a bearing device 23 in combination with a non-rotating take-up plate 25 located in housing 3, which is coupled via a connecting rod to at least one piston, which reciprocates in the direction of its longitudinal axis 29 when the swash plate rotates via the take-up plate 25. The longitudinal axis 29 of the piston 27 normally runs parallel or parallel to rotational axis 17 of the rotatable swash plate 21. However, it is also possible that the axes are at an angle to each other. The important fact is that the longitudinal axes of the pistons do not run at right angles to the rotational axis 17 of the drive shaft, so that a so-called axial piston pump or compressor is formed.

The take-up plate 25 is supported via a support device 127 on an thrust bearing 129, which is fitted in housing 3 so that it cannot turn. The thrust bearing 129 has two bearing surfaces, of which bearing surface 145 is shown in FIG. 1.

The example represented in FIG. 1 has several pistons. Only one further connecting rod 26' and associated piston 27' are shown here, the rod reciprocates in relation to its longitudinal axis and is coupled to take-up plate 25. The longitudinal axis 29' of piston 27' also runs parallel to the rotational axis 17 here. The pistons are run in bores 31 and 31', which are located in a cylinder block 35. This lies flat on a valved plate 37, through which the compressed medium from the compressor is transferred into a pressure area 39, denoted also as a high pressure chamber, located in the second housing section 7. The second housing section 7 contains a further pressure area, the second pressure area 39', which represents the suction area for the pressurized medium. The medium located in the second pressure area 39' can have a pressure of up to 40 Bar or above. The pressure areas are separated from each other by a first dam 40. A second dam 40 seals the first pressure area 39 in relation to the environment. The dams can be fitted with suitable seals and lie directly next to the cylinder block 35 or—as in the example construction represented in FIG. 1—on the valve plate denoted as valve disk 37, which acts in connection with the cylinder block.

The cylinder block 35 has a rotating mounting flange 41, the height of which is significantly less than the total height of the cylinder block, for example less than a quarter of the total height.

The mounting flange 41 is clamped between a first clamping shoulder 43 on the first housing section 5 and a second clamping shoulder 45, that is fitted in the second housing section 7. The first clamping shoulder 43 is created because the wall thickness of first wall area 47 of the first housing section 5 in the area of the hollow 9 is significantly greater than in the area of the mounting flange 41 and the valve plate 37. A second wall area 49, which is significantly less thick that the first wall area 47 originates from the first wall area 47. There is a sealing device 51 in the area of the first clamping shoulder 43, which may for example consist of an O-ring inserted into a groove 53, which is not shown here. This design ensures that the pressure n the hollow 9 can only act upon the first wall area 47 and is screened from the second wall area 49, so that it can be significantly thinner.

The second wall area 49 extends over a section of the second housing section 7 and is located there in an indentation 55, so that there is a continuous external surface of housing 3. The end of the indentation 55 and the second wall area 49 is constructed such that there is a circumferential v-groove 57, in the area of which the two housing sections 5 and 7 can be welded. By the use of a laser welding process the v-groove 57 can be avoided. Basically, however, the desired method of connecting the housing sections 5 and 7 is possible, to seal housing 3 in an airtight manner. The v-groove 57 is located to the right of mounting flange 41 and in the area of the second housing section 7 in FIG. 1, so that when the two housing sections are connected the second housing section 7 can be pressed against the valve plate under pre-stressing.

In the external area of the second housing section 7, supported on the right-hand surface of the valve plate 37, thus in the area o the clamping shoulder 45, a seal 59 is again fitted, which has a circumferential groove 61, in which an O-ring can be fitted. This seal 59 ensures that the medium in pressure area 39, which is under a high excess pressure, cannot reach the second wall area 49, so that it is not subject to any radial outward acting pressure forces, only axial tensile forces.

It is clear from the sectional representation that a relief bore E can be located in the second wall area 49, through which coolant that travels underneath the second wall area 49 by passing through the seal 51 or the seal 59 can be discharged to the environment. In this manner overpressure under the second wall area 49, which could give rise to radial outward acting compressive force, is avoided. It is therefore possible to make the wall so thin that it is only suitable for taking up axial tensile forces.

If the drive shaft 15 is set in rotation by the pulley 13, then the swash plate 21 turns in relation to the take-up plate 25, which rests on the non-rotating support bearing 129, and therefore does not follow the rotation of the swash plate 21. The take-up plate 25, together with the swash plate 21, wobbles, so that the pistons 27 and 27' reciprocate in the direction of their longitudinal axes 29 and 29'. In this manner a medium is transferred via a flap valve into the pressure area 39 and from there travels to a consumer. For example the compressor 1 conveys a compressible medium for a vehicle air conditioning unit.

In the operation of the compressor 1 high pulsation force occurs due to the reciprocal movement of the pistons 27, 27' and any further pistons. These forces are conducted via the take-up plate 25 and the bearing 23 into the swash plate 21. From here the forces travel into the drive shaft 15. As this is anchored to the cylinder block 35 via a fixed bearing 63, the forces, for example tensile forces in the drive shaft, are transferred into the cylinder block. The fixed bearing 63 comprises elements shown in drawing FIG. 1. There is a radial bearing 161 between the rotating shaft 15 and the stationary cylinder block 35 which absorbs radial forces. There is an axial bearing arrangement which comprises a nut 163 that is fixed to the drive shaft 15 and rotates therewith, a washer 165 that is supported by the cylinder block 35 and an axial bearing 167 between the nut 163 and the washer 165 which enables rotation between the nut 163 on the shaft 15 and the stationary washer 165 in the cylinder block. Through the foregoing, the drive shaft is anchored and fixed to the cylinder block. Tensile forces in the drive shaft are thereby transferred into the cylinder block. Other forces are transferred under high pressure through the medium into the pressure area 39 by the pistons 27, 27' and act on the second housing section 7, attempting to lift it from the valve plate 37 or from the first housing section 5. As the first housing section 5 and the second housing section 7 are rigidly connected together in the area of the V-groove 57, the forces acting on the second housing section 7 are transferred back to the cylinder block 35 via the second wall area 49 and via the first clamping shoulder 43, giving a closed line of force. Due to this design and the layout of the moveable bearing 19 represented in FIG. 1 it is possible to ensure that the housing 3 is, to a large degree at least, free of forces, i.e. the forces transferred via the drive shaft into the inside of the housing are not transferred to the housing.

It is clearly shown that the lines of force run almost entirely in the inside of the compressor 1, and only run in the outer area of the housing 3 in the small wall section of housing 3 that is made up of the second wall area 49. Pulsations and vibrations that occur during the operation of the compressor 1 therefore remain, apart from a very small proportion, entirely enclosed within the inside of housing 3, so that the noise emissions of the compressor 1 are greatly reduced compared to conventional compressors, in which the entire axial forces in the direction of the rotational axis 17 are transferred via the external housing wall, therefore particularly via the first wall area 47, to the drive shaft 15, giving a very large emission area.

Noise emissions are further reduced by the fact that in the connecting area between the housing sections 5 and 7 the second wall area 49 is rigidly connected to the base of the second housing section 7, so that vibrations are greatly damped. This leads to a damping of the noise emissions. It is clear that the type of connection between the housing sections 5 and 7 does not matter. A welded housing 3 is distinguished by a very compact construction and simple method of manufacture. It is, however, also possible to connect the end of the second wall area 49 with a flanged edge or with an edge-raised groove by deformation, which can be fitted onto the second housing section 7.

In both cases it is possible to firmly clamp the cylinder block 35 or the clamping flange 41 between the clamping shoulders 43 and 45, which are fitted to the housing sections 5 and 7, so that there is only an external emission surface for air and structure-borne emissions in this small clamping area. To ensure optimal rigidity, the second wall area 49 is formed to partially take in the second housing section 7 so that the connection area between the first housing section 5 and the second housing section 7 lies at a distance from the clamping area between the two clamping shoulders 43 and 45.

The important point is that additional fitting elements can be avoided by the direct connection of the two housing sections 5 and 7 by welding or flanging, which greatly reduces the radiating surfaces that produce air-borne and structure-borne noise. At the same time a very simple, compact construction of compressor 1 is achieved.

It is particularly advantageous that, with the method of connecting the housing sections 5 and 7 described here, the sections can be axially pre-stressed, for example by subjecting the second wall area 49 to a warming process prior to welding or flanging so that there is an axial expansion. It has also become evident that because of the fact that a fixed bearing 63 is fitted in the cylinder block the compressor structural shape is very short, whereby the total external area of the compressor is again relatively small compared to conventional structural shapes.

As the drive shaft 15 is carried via a fixed bearing in cylinder block 35, there is a common datum level for the drive shaft 15 and for the other parts of the pump unit 11, for example for the pistons 27, 27' and their connecting rods 26 and 26'. Even if the present compressor 1 has a housing 3 made of aluminium and a drive shaft 15 made of steel, when the compressor is warmed the so called clearance volume, namely the volume when the piston is at top dead centre, remains very small.

The compressor described according to FIG. 1 is suited for an outlet pressure of between 10 Bar and 200 Bar.

FIG. 1 shows that the take-up plate 25 continues into a projection 137, which is part of the support device 127 and works in combination with a support element 139, which for its part is part of the support device 127. The thickness of the projection 137 is the same as that of the take-up plate 25, giving particularly high solidity. The support element 139 encompasses a sliding surface, which slides upon the bearing surface 145 of the thrust bearing 129. In the representation according to FIG. 1 the support element 139 is located in its further left deflection. The furthest right deflection of the support element 139 is indicated by a dotted circle 141, which should indicate the opposite swing position of the swash plate 21. In the position represented here, the upper piston 27 is in its uppermost position in the cylinder bock 35, which is also known as top dead center, whilst the lower piston 27' is practically at its maximum waiting position, also know as bottom dead center.

Figure 2:
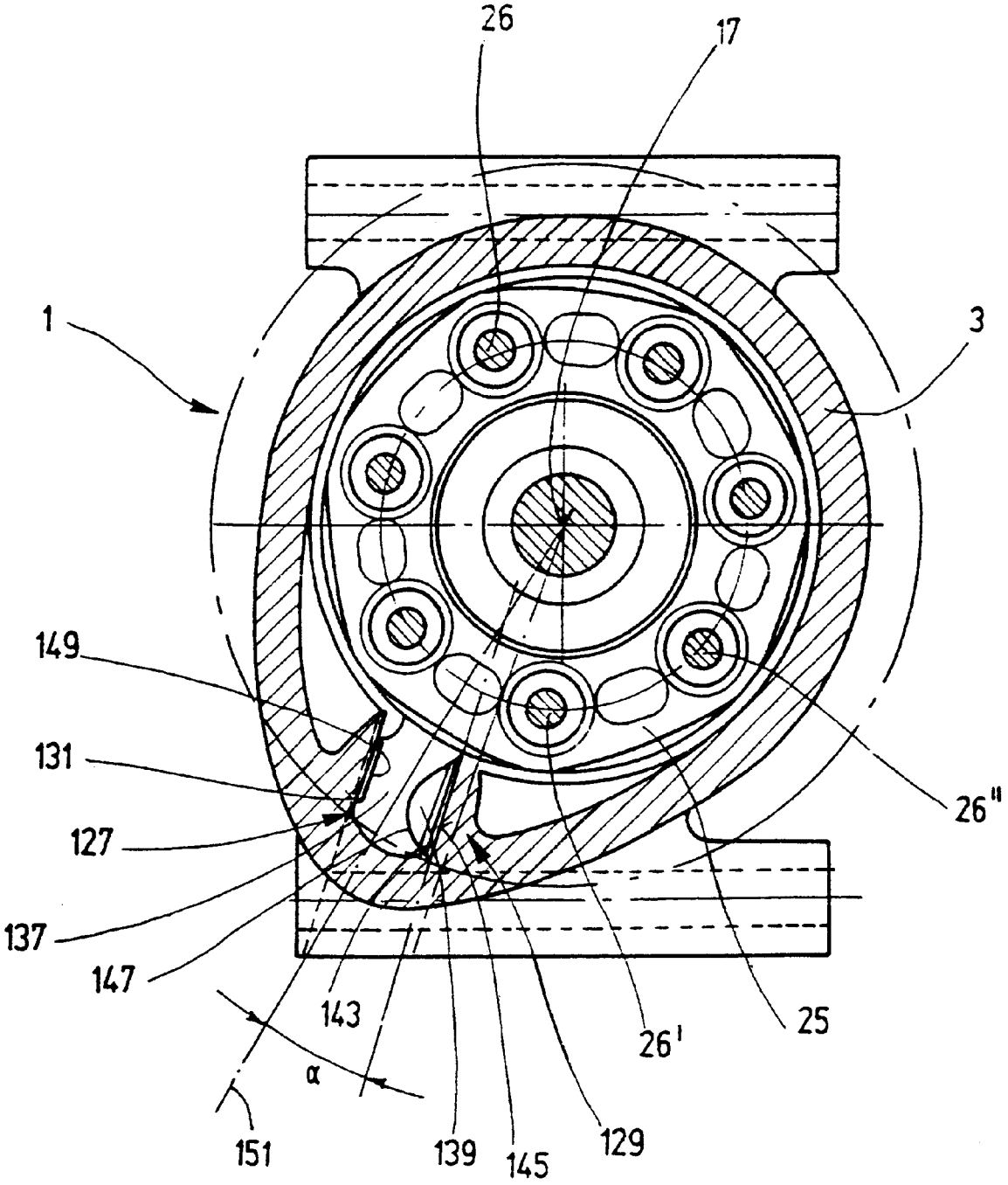
FIG. 2 is a cross-section through the compressor shown in FIG. 1.

FIG. 2 shows a cross-section through the compressor 1. The same parts have the same reference number, so that the description for FIG. 1 can be referred to.

Figure 5:
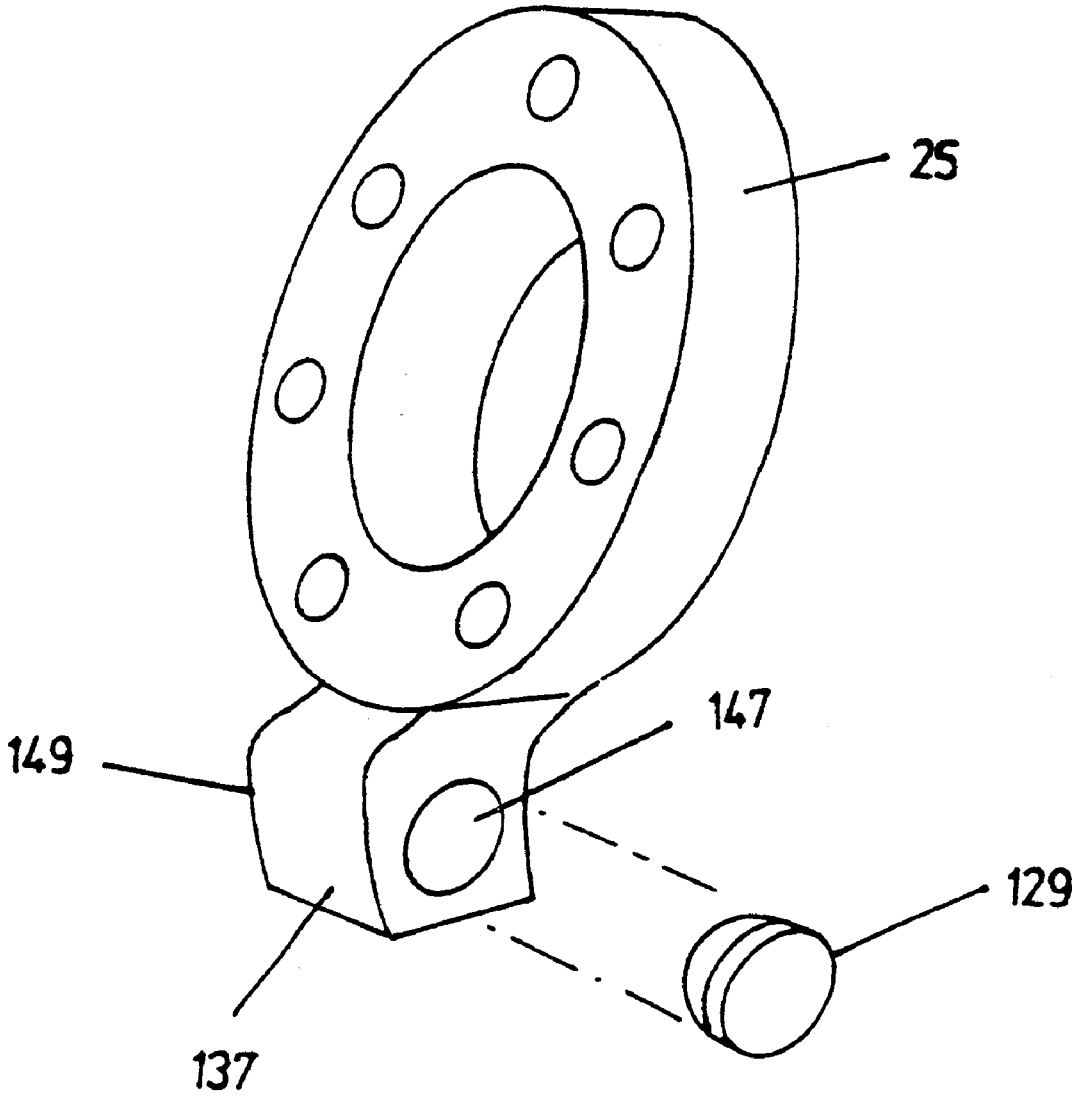
FIG. 5 is a drawing showing an enlarged view of a take-up plate and support.

Referring to FIGS. 2 and 5 the compressor 1 has seven connecting rods 26, 26', 26" and so on, equally spaced in the longitudinal direction. It is clear from the drawing that the take-up plate 25 ends in a projection 137, which is part of the support device 127. The projection 137 is connected to the take-up plate 25 as one piece. It works in connection with the support element 139, which slides along a bearing surface 145 of the thrust bearing 129 with a first sliding surface 143. The projection 137 and the support element 139 are positively connected together. A second sliding surface 147 is formed in their contact area, which is preferably spherically curved. Here the projection 137 has a—preferably spherically—curved indentation, in which a curve of the support element 139—preferably formed as a spherical section—engages. This ensures that the support element 139 is carried along with the reciprocation of the projection 137. Therefore no additional securing elements are required to couple the two sections of the support device 127 together.

On the opposite side of the projection 137 to the support element 139 there is a third sliding surface 149, which works in combination with the bearing surface 145 of the thrust bearing 129 represented in FIG. 1.

FIG. 2 shows that the first bearing surface 131 and the second bearing surface 145 of the thrust bearing 129 run generally parallel to each other. It is also possible, that they form an acute angle with each other, which opens out towards the take-up plate 25. The drawing also shows that the bearing surfaces and an imaginary line 151 intersecting rotational axis 17 form an angle $\alpha$. This is an acute angle of approximately 12°.

It is, however, also possible to have the bearing surfaces parallel to the radially running line 151. This design is not represented separately here.

Figure 3:
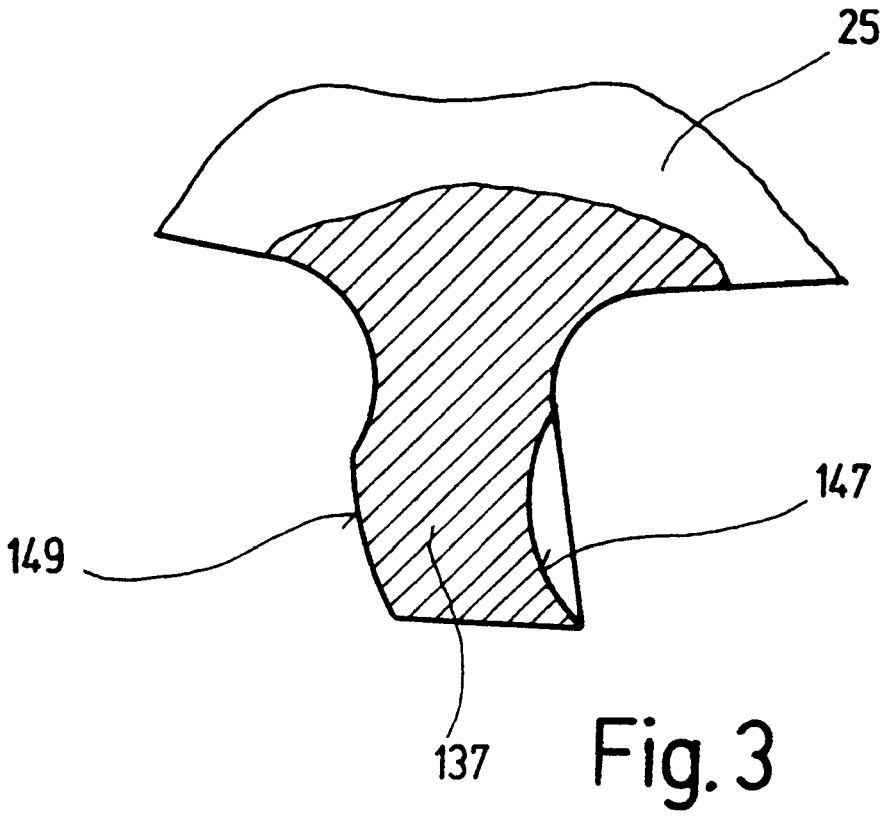
FIG. 3 is a detailed enlargement of a longitudinal section modified design of the support device shown in FIG. 1.

FIG. 3 shows a modified design for the projection 137 of the support device 127. This is distinguished by the fact that the third sliding surface 149 is not straight, but is curved. It is therefore possible to permit a tipping or swinging movement of the projection 137 in relation to the first bearing surface 131.

Figure 4:
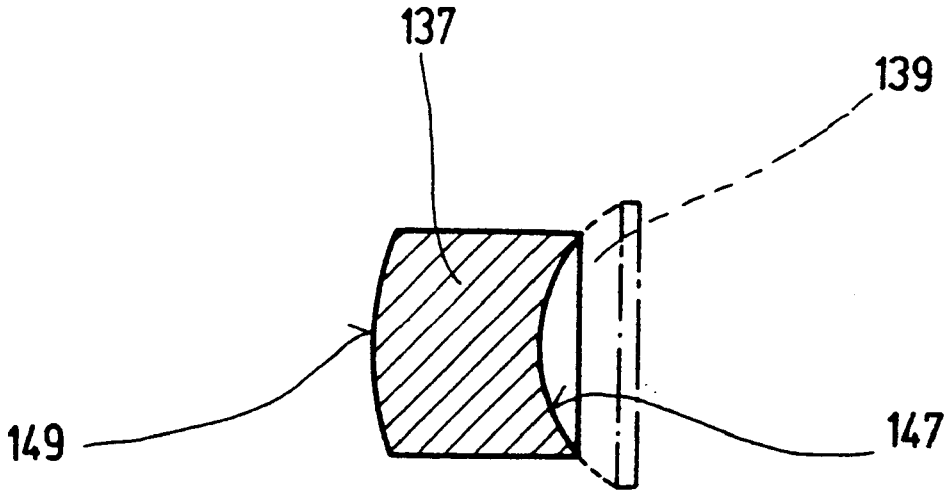
FIG 4 is a detailed enlargement of a modified design of the support device in cross-section.

A further variant can incorporate a curve in the third sliding surface 149 perpendicular to the curve shown in FIG. 3. It is also feasible to imagine a variant with only one of the aforementioned curves shown. This variant is represented in FIG. 4, which shows the projection 137 in cross-section. In both cases the second sliding surface 147 can be recognized. The support element 139 is, however, not reproduced here. It is only shown in FIG. 4 as a dotted line.

Because of the additional curve of the third sliding surface 149 represented in FIG. 4, a swinging movement in relation to a line perpendicular to the focal plane in FIG. 4 is also possible.

All variants having in common the fact that the two bearing surfaces 131 and 145 and/or the sliding surfaces 143, 147 and 149 have a particularly resistive layer. It is also possible to coat the bearing surfaces 131 and 145 of the thrust bearing 129 with a resistive metal strip. This is particularly advantageous for a cost effective realisation if the housing 3 of the compressor 1 is made of a relatively soft material, for example aluminium, so that wear to the bearing surface of the thrust bearing 129 is to be feared. It is, however, feasible to use a siliceous aluminium for the manufacture of the housing, so that the bearing surfaces are intrinsically relatively resistive. In this case coating the bearing surfaces can be avoided.

The sliding surfaces can also be given a resistive coating, which can also be called a wearing coat. It is particularly advisible to provide the first sliding surface 143 of the support element 139 with this type of wearing coat. It is, however, also possible to manufacture the support element 139 from a resistive material, for example steel, thereby reducing to a minimum the wear during interaction with the thrust bearing 129.

The special design of the third sliding surface 149 represented according to FIGS. 3 and 4, can not only be used in the variant according to FIG. 2, in which the bearing surfaces of the thrust bearing 129 form an angle $\alpha$ with an imaginary line 151. Rather, it is possible to have a curved sliding surface with a projection that works in combination with an thrust bearing, the bearing surface of which runs parallel to the above mentioned line 151.

From the above, it is clear that for the compressor construction represented here an optimal support of the take-up plate 25 on a thrust bearing 129 of a housing 3 is possible. FIG. 2 shows that the thrust bearing 129 can be formed as a single piece with housing 3, thus representing part of the housing, giving a very simple and economical construction. From the sectional representation in FIGS. 3 and 1 it is clear that the projection 137 is formed as one piece with the take-up plate 25, and so there is therefore no weakening of the take-up plate or the projection 137, as is often the case for the state of the art. It is also clear that the support device 127 is very simply constructed and only has one support element 139, that is positively secured onto projection 137 by a second sliding surface 147. It is also feasible to have the opposite curve on the sliding surface and to provide the projection with a spherical section curve that engages with a support element having a suitable indentation. Here, too, a relative movement between the projection and support element is possible, as is the case for the construction example represented here. At the same time, the simple construction of the support device is ensured, making an economical and functional [realization] realization possible.

The compact construction of the support device ensures that the torque transmitted to the take-up plate 29 is safely taken up. An optimal power feed to the take-up plate is therefore achieved.

The construction of the support device 127 shown in the Figures contains a peculiarity: the projection 137 rests via support element 139 on the corresponding second bearing surface 145 particularly well. Because of the rotation of the swash plate 21, for example anti-clockwise, a torque is introduced into the take-up plate, so that the projection 137 is pressed against the second bearing surface 145. In the design selected here, the preferred direction of rotation of the swash plate 25 is therefore pre-determined. According to FIG. 2 it runs anti-clockwise. Therefore, if the compressor runs in the opposite direction, then the support device 127 should be designed as a quasi mirror image, to ensure optimal torque support. Particularly low surface pressures are achieved in interaction with the support element 139 and the thrust bearing 129, therefore also giving the preferred direction of rotation of the compressor.

As described above based on FIG. 1, the drive forces from the pulley 13 driven by a vehicle internal combustion engine are transmitted via the drive shaft 15 which rotates around the rotational axis 17. The swash plate 21 is connected to the drive shaft 15. It is set in rotation via a carrier 119, that here engages with a recess 121 running perpendicularly to the rotational axis 17 of the drive shaft 15, the base of which is preferably level and is manufactured, for example, by a milling process in the peripheral surface of the drive shaft 15. The carrier 119 is connected to the drive shaft by welding, friction welding, gluing, soldering or similar. The construction example represented in the Figure therefore shows a material connection between the carrier 119 and the drive shaft 15. The contact area 122 between carrier 119 and drive shaft 15 can also be differently formed. It is, for example, also possible to give the carrier or the drive shaft a curved surface and the other piece a corresponding indentation. The carrier can also have a partial cylindrical recess, which can be placed on the external surface of the drive shaft 15 and connected with this.

It is, however, aoso possible to design the drive shaft and carrier as a single piece, thereby transmitting the driving forces introduced into the drive shaft 15 via the pulley 13 to the swash plate 21.

It is immediately clear from the sectional representation according to FIG. 1 that the carrier 119 is coupled to the drive shaft 15 without any devices (bolts or pegs) in such a manner that torque can be transmitted from the pulley 13 to the swash plate 21. This is rigidly connected to the drive shaft in the axial direction so as not to rotate. This makes it unnecessary for the carrier 119 to encompass the drive shaft 15 or for the two components to be pressed together, giving rise to a smaller space requirement than is the case for conventional compressors. Because the carrier itself is very small, the swash plate can swing out further, meaning that the compressor itself is smaller than conventional compressors.

To sum up, a compressor can be realized using one or more of the constructional measures described according to FIGS. 1 to 5, that has a simple and therefore economical and compact construction. Particularly preferred is a variant of the compressor in which the carrier and drive shaft are materially connected together or made as one piece. The support device of the take-up plate includes one of these projecting support elements that has a first sliding surface that works in combination with a bearing surface of the thrust bearing, whereby the projection and the support element are positively connected together via a second sliding surface. The construction of this preferred construction example can be further simplified by constructing the compressor as two sections, whereby the two housing sections each have a clamping shoulder, between which the cylinder block is clamped. The drive shaft is carried in the cylinder block by a fixed bearing that supports or can absorb forces acting in the axial and radial direction. Furthermore, it is particularly advantageously here that by clamping the cylinder block between the tow housing sections, the radiation surface for the creating of air-borne or structure-borne noise is reduced. The compressor described above is particularly advantageous for us in an air conditioning system in a vehicle due to its short and compact construction and low noise emissions. The required space for the compressor can be further reduced by the material connection of carrier and drive shaft. Naturally, a compressor in which only one or two of the constructions measures described above are used can also be realized in which the disadvantages of familiar compressors are avoided or at least reduced.

What is claimed is:

1. A compressor for a vehicle air conditioning system, the compressor comprising:

a cylinder block;

at least one piston movably mounted in the cylinder block so that the piston is effective to reciprocate within the cylinder block, the piston further being effective to convey a medium from the compressor;

a drive shaft connected with the piston for driving the piston; a fixed bearing connecting the drive shaft to the cylinder block, the fixed bearing being disposed so as to cooperate with a member fixed to the drive shaft, said member includes a nut, to substantially absorb forces emanating from the drive shaft, wherein the forces emanate from the drive shaft in at least an axial direction and in a radial direction with respect to the drive shaft.

2. The compressor as recited in claim 1, further comprising:

a housing;

a carrier coupled to the drive shaft;

a swash plate coupled to the carrier and effective to rotate about an axis defined by the drive shaft; and a take-up plate coupled to the swash plate and further coupled to the at least one piston, the take-up plate being movably mounted in the housing through a non-rotating thrust bearing.

3. The compressor as recited in claim 2, wherein the drive shaft and the carrier are at least one of connected together by a material and constructed as a single piece.

4. The compressor as recited in claim 1, wherein the carrier is integral with the drive shaft.

5. The compressor as recited in claim 1, further comprising a housing and wherein:

the housing comprises a first and second housing section;

each housing section includes a clamping shoulder; and the cylinder block is clamped between the clamping shoulders.

6. The compressor as recited in claim 5, wherein the housing sections are welded together.

7. The compressor as recited in claim 5, wherein the housing sections are connected together by deforming at least one of the housing sections.

8. The compressor as recited in claim 5, wherein the housing sections are connected together by flanging.

9. The compressor as recited in claim 5, wherein the first housing section includes a void which is effective to receive at least a portion of the second housing section.

* * * * *